US007828557B2

(12) United States Patent
Vogt et al.

(10) Patent No.: US 7,828,557 B2
(45) Date of Patent: Nov. 9, 2010

(54) CONNECTOR FOR BOARD-MOUNTED LED

(75) Inventors: Karl-Wilhelm Vogt, Ense (DE); Daniel Tauber, Iserlohn (DE); Freddi Plikun, Arnsberg (DE)

(73) Assignee: BJB GmbH & Co. KG, Arnsberg (DE)

( * ) Notice: Subject to any disclaimer, the term of this patent is extended or adjusted under 35 U.S.C. 154(b) by 0 days.

(21) Appl. No.: 12/356,981

(22) Filed: Jan. 21, 2009

(65) Prior Publication Data

US 2009/0191725 A1 Jul. 30, 2009

(30) Foreign Application Priority Data

Jan. 24, 2008 (DE) ..... 10 2008 005 823

(51) Int. Cl.
*H01R 12/00* (2006.01)

(52) U.S. Cl. ..... 439/56; 439/441

(58) Field of Classification Search ..... 439/56, 439/59, 489, 490, 500, 441, 699.2; 362/800
See application file for complete search history.

(56) References Cited

U.S. PATENT DOCUMENTS

| | | | | |
|---|---|---|---|---|
| 4,361,371 | A * | 11/1982 | Williams | 439/76.1 |
| 5,259,767 | A * | 11/1993 | Kurbikoff et al. | 439/59 |
| 5,920,252 | A | 7/1999 | Nakagawa | 338/160 |
| 7,118,255 | B2 * | 10/2006 | Galli | 362/373 |
| 7,182,627 | B1 * | 2/2007 | Huang | 439/487 |
| 7,204,711 | B2 * | 4/2007 | Garcia et al. | 439/336 |
| 7,211,835 | B2 | 5/2007 | Ono | |
| 7,258,466 | B2 | 8/2007 | Watanabe et al. | |
| 7,357,534 | B2 * | 4/2008 | Snyder | 362/294 |
| 7,441,933 | B2 | 10/2008 | Tsukamoto et al. | |
| 7,448,901 | B2 | 11/2008 | Weber | 439/427 |
| 7,535,727 | B2 | 5/2009 | Tokida | |
| 7,540,761 | B2 * | 6/2009 | Weber et al. | 439/487 |
| 7,602,112 | B2 * | 10/2009 | Peeters et al. | 313/318.07 |
| 2002/0006042 | A1 | 1/2002 | Marquardt et al. | 362/267 |
| 2003/0183417 | A1 | 10/2003 | Brown | 174/260 |
| 2005/0201100 | A1 * | 9/2005 | Cassarly et al. | 362/317 |
| 2006/0067077 | A1 * | 3/2006 | Kumthampinij et al. | 362/294 |
| 2007/0070631 | A1 | 3/2007 | Huang | 362/311 |
| 2007/0206369 | A1 | 9/2007 | Takeda et al. | |

FOREIGN PATENT DOCUMENTS

| | | |
|---|---|---|
| DE | 8711882 | 12/1987 |
| DE | 2007007779 | 8/2005 |
| DE | 2005043658 | 6/2006 |
| DE | 2006000380 | 3/2007 |

* cited by examiner

*Primary Examiner*—T C Patel
*Assistant Examiner*—Harshad C Patel
(74) *Attorney, Agent, or Firm*—Andrew Wilford

(57) ABSTRACT

A printed circuit board having an upper face provided with contact traces and pads with a light-emitting diode fixed to the board and connected to the traces. A connector juxtaposed is with the pads and carries a contact element having a leg bearing with spring force on one of the pads and formations gripping a hookup wire. At least one fastener engages through the connector and circuit board with a heat-sink base and presses the connector against the circuit board and the circuit board against the base.

17 Claims, 4 Drawing Sheets

CONNECTOR FOR BOARD-MOUNTED LED

FIELD OF THE INVENTION

The present invention relates to a connector for a light-emitting diode (LED) mounted on a circuit board. More particularly this invention concerns a light fixture incorporating such an LED.

BACKGROUND OF THE INVENTION

LEDs are being used with increasing frequency in the lighting industry as a replacement for conventional light sources, such as electric light bulbs and fluorescent light fixtures, for reduced energy consumption and smaller fixture size. Examples of lighting of this type are step lights, emergency lighting and path lighting to identify emergency exit routes as well as lighting installed in the floor for decorative purposes. Furthermore, the LED is becoming increasingly important as lighting to replace conventional room and building lighting. Lights utilizing LEDs arranged on a printed circuit board are known, for example, from DE 10 2004 004 779 or U.S. Pat. No. 7,182,627.

High-output LEDs, as are increasingly being used, however, have higher losses that becomes noticeable in the form of heat. Since LEDs are very heat-sensitive and in particular their service life is reduced by heat, an effective cooling must be ensured. To this end the trend is increasingly to mount the LED on a printed-circuit board, the material of which, for example, aluminum, is a good thermal conductor. The LED mounted on a printed-circuit board of this type is usually mounted on a base forming part of a cooler using a so-called thermal paste. This also ensures an effective heat removal and thus serves as a heat sink.

For specific purposes it has become customary among manufacturers to attach an individual LED on a so-called star circuit board that has contact traces coated with solder. The individual star arms are separated from one another by part-circular sections. Screws extend through them so that the screw heads bear against the printed-circuit board and hold it down on the support body. Electrical hookup cables are soldered onto the contact traces by means of conventional soldering techniques.

The lighting industry, which uses LEDs of this type for production, prefers solderless connection of the hookup cables, since this facilitates assembly and makes it possible to replace defective LEDs easily. A solderless connection technology of this type is disclosed by US 2007/0070631, in which several LEDs mounted on a printed-circuit board can be used by means of suitable connection technology in conventional light fixture holders for fluorescent light fixtures. This solution may be specifically suitable for the replacement of fluorescent light fixture tubes, but is not suitable for other purposes.

Another solderless electrical connection of LEDs in the automotive field is disclosed by US 2003/0183417, which proposes a bayonet-like fixing of an LED, the LED in this case not having a printed-circuit board.

DE 87 11 882 also proposes a solderless electrical connection with an LED without a printed-circuit board.

OBJECTS OF THE INVENTION

It is therefore an object of the present invention to provide an improved connector for board-mounted LED.

Another object is the provision of such an improved connector for board-mounted LED, in particular a star circuit board, that overcomes the above-given disadvantages, in particular that makes possible a solderless connection of the electrical hookup cable that is easy to use.

SUMMARY OF THE INVENTION

A printed circuit board having an upper face provided with contact traces and pads with a light-emitting diode fixed to the board and connected to the traces. A connector juxtaposed is with the pads and carries a contact element having a leg bearing with spring force on one of the pads and formations gripping a hookup wire. At least one fastener engages through the connector and circuit board with a heat-sink base and presses the connector against the circuit board and the circuit board against the base. Thus the hookup cables or wires are connected in solderless manner, and the hookup wires are connected without the use of solder or screws also.

A connector of this type makes it possible for the lighting industry to use conventional screwless and solderless connection techniques feeding current to the LED. Thus according to the invention the connector overlays the printed-circuit board at least in the area of the contact pads and the areas of the connector overlaying the printed-circuit board hold contact elements in the form of pressure contacts for support on the contact pads, in particular if the contact elements have contact terminals for solderless and/or screwless connection of hookup cables.

The manufacture of light fixtures can be further simplified if the connector holds the printed-circuit board between it and a base, in particular a cooling unit and thus serves for the electrical connection of the LED and the anchoring of the LED, the connector in particular serving to connect an LED printed-circuit board, which is embodied as a star circuit board according to the invention.

Another embodiment is characterized in that the connector is essentially annular in shape and has housings open toward the printed-circuit board to receive the contact elements, and the housings in addition form insertion openings to receive hookup cables. The housings thereby ensure a secure fit of the contact elements in the connector and in addition an electrical insulation.

The connector in accordance with the invention has cutouts for accommodating fasteners, in particular screws, by means of which the connector can be fixed.

An embodiment is particularly preferred in which the cutouts of the connector are aligned with the spaces between the arms of the star-shaped circuit board, so that the fasteners for fixing the printed-circuit board engage directly in the base. With a connector of this type the formation of an electrical connection between the connector and the contact pads of the LED printed-circuit board and the attachment of the LED can be carried out in one step, which considerably simplifies the light fixture production.

In a further development of the invention the LED is mounted on the printed-circuit board by means of a socket that has a certain outer shape and the connector has at least in part a shape congruent to and aligned with the LED socket. This ensures that the connector is correctly positioned on the printed-circuit board.

The connector can thus be made in a further embodiment such that it is adapted to several different outer shapes of different LED bases. This way different printed-circuit boards can be fitted to the same connector. Thus a single connector can be produced for several different LEDs, which is a considerable advantage for the production as well as for the distribution of connectors of this type.

If according to a particularly preferred embodiment of the invention the connector has a holder or part that holds devices influencing the light of the LED, in particular lenses directing the light, the above-mentioned centering device furthermore has the important role that a light-influencing device of this type is correctly arranged above the LED. Furthermore, holders of various lenses hitherto used which direct, in particular focus or scatter the light of the LED are integrated into the connector, which considerably reduces the number of components and renders possible the production of preassembled units.

Thus the lens holder is connected in one piece to the connector or is detachably fixed on the connector. In the latter case the lens holder and the connector have latch formations for detachably fixing to each other.

When the lens holder and the connector are separated, there is the possibility of preassembling and providing connectors including lens holders according to a modular system.

BRIEF DESCRIPTION OF THE DRAWING

The above and other objects, features, and advantages will become more readily apparent from the following description, reference being made to the accompanying drawing in which.

SPECIFIC DESCRIPTION

Figure 2:
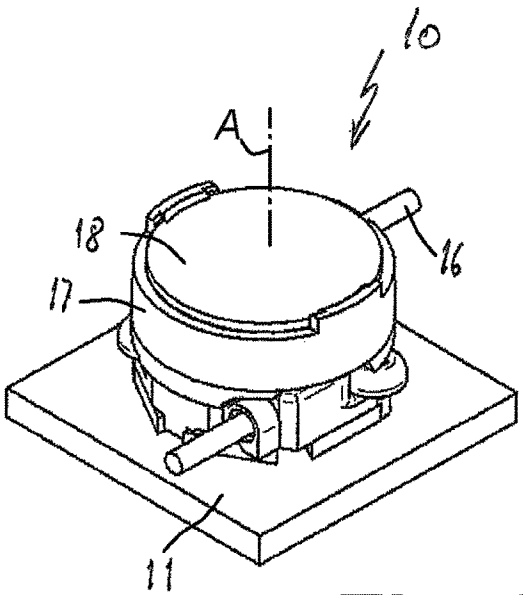
FIG. 2 shows the light fixture of FIG. 1 in the assembled state.
Figure 1:
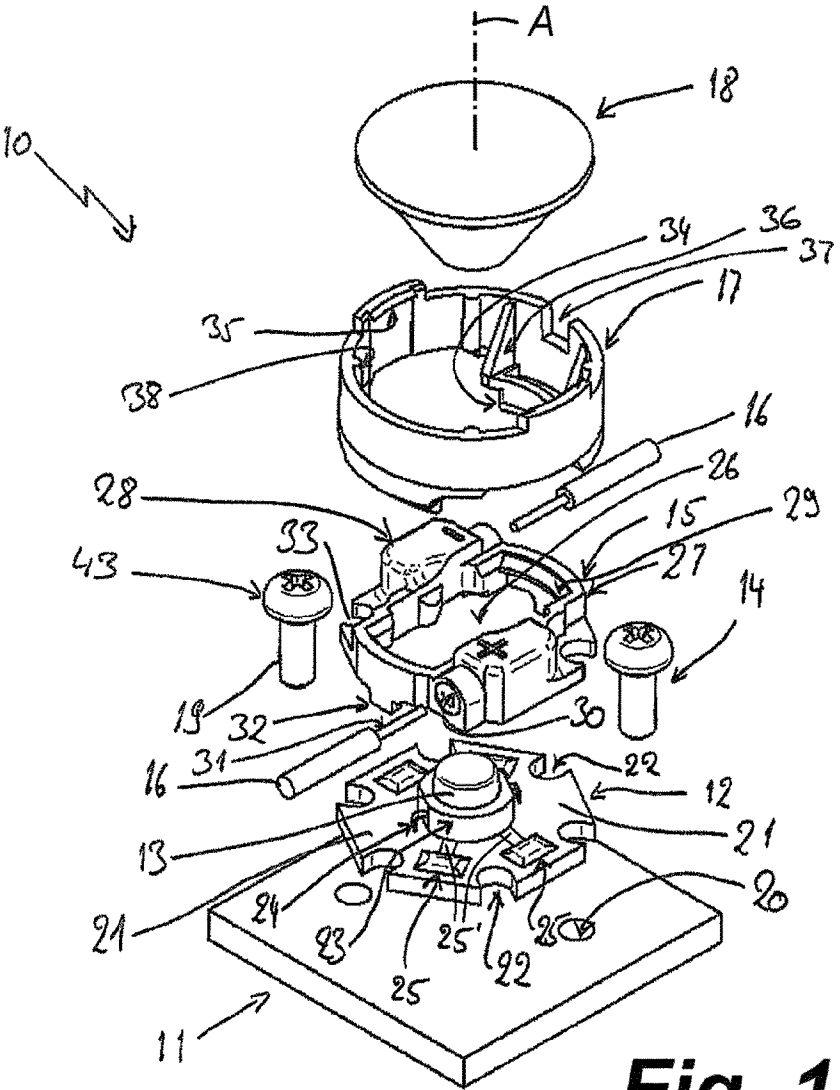
FIG. 1 is an exploded view of an LED light fixture and connector according to the invention and lens holder mounted on a flat base.

As seen in FIGS. 1 and 2 an LED light fixture 1 according to the invention has a base 11, a star circuit board 12 carrying an LED 13, a connector 15 that can be mounted on the base 11 by means of screws 14 and that serves for solderless connection of hookup cables 16, a lens holder 17, and a lens 18. The structure is generally centered on an axis A passing centrally through the LED 13 and perpendicular to the plane of the base 11.

The base 11 has a dual function for the light fixture 10. On the one hand, the light fixture 10 is attached to the base by means of the screws 14; on the other hand, the base serves to dissipate heat generated by the LED 13. The base 11 as well as the star circuit board 12 is made from a material that conducts heat well, usually aluminum. Threaded bores 20 in the base 13 receive the shanks 19 of the attachment screws 14.

The star circuit board 12 here has six arms 21 separated by radially open cutouts 22 essentially in the shape of a circle segment The LED 13 is mounted in a socket 23 atop the star circuit board 21 and is connected via contact feet 24 (FIG. 4) and conductor traces (not shown) to contact pads 25 on the upper face of the star circuit board 12. The contact fields or pads 25 are usually coated with solder in order to form a soldered connection with hookup cables in a simple manner.

The connector 15 according to the invention is essentially annular and rests on the star circuit board 12 in the assembled condition according to FIG. 2. It delimits an interior space 26 that is surrounded by a collar 27 and serves to accommodate the LED 13 together with its socket 23.

Figure 4:
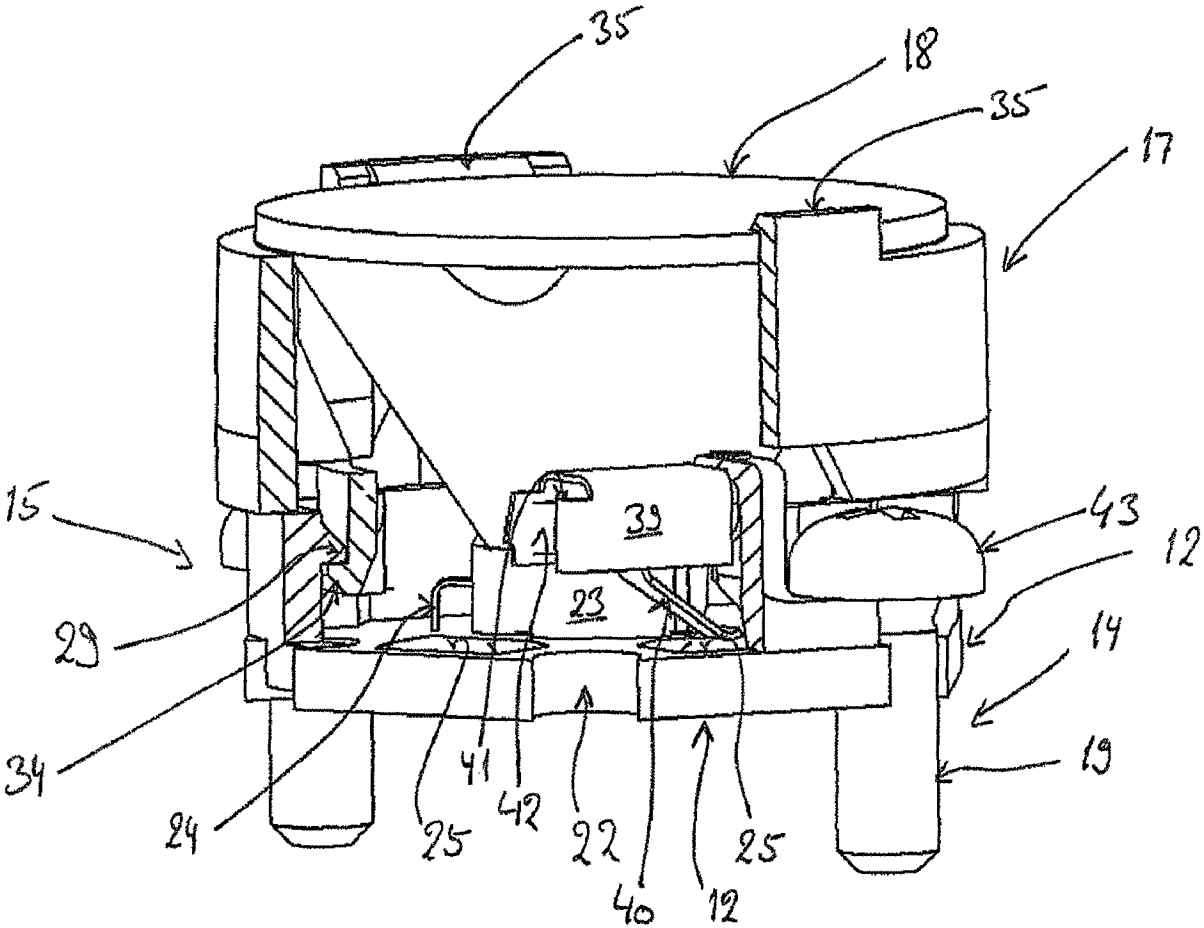
FIG. 4 shows elements of the LED light fixture partly in section.

The collar 27 forms two diametrically opposite housings 28 that flank the lens holder 17 and that are formed with radially inwardly directed retaining barbs 29 (FIG. 4). Each housing 28 is open axially downward toward the star circuit board 12 and has a connecting-cable insertion hole 30 open tangentially to the outside of the collar 27 and through which stripped ends 31 of the hookup cables 16 can engage with a contact terminal inside the respective housing 28. To position the connector 15 on the star circuit board 12, the collar 27 is provided with two axially downwardly projecting positioning tabs 32 that, when resting on the star circuit board 12, engage in respective opposite cutouts 22 of the board 12. The connector 15 also forms cutouts 33 in the shape of a circle segment, in this case two, that are of the same shape and size as the cutouts 22 and that can be aligned with them axially.

The lens holder 17 is an essentially circular ring formed with diametrically opposite and axially downwardly extending latch projections 34 on its underside facing toward the printed-circuit board 12 that can fit and latch with the barbs 29 on the connector 15. Axially upwardly projecting and downwardly barbed tabs 35 fit around and over the lens 18 to hold it down on the holder 11. Triangular webs 36 fit against the frustoconical side of the lens 18 and a positioning groove 37 and ridge 38 fit in complementary formations on the lens 18 to ensure perfect and fixed positioning of the lens 18.

Figure 3:
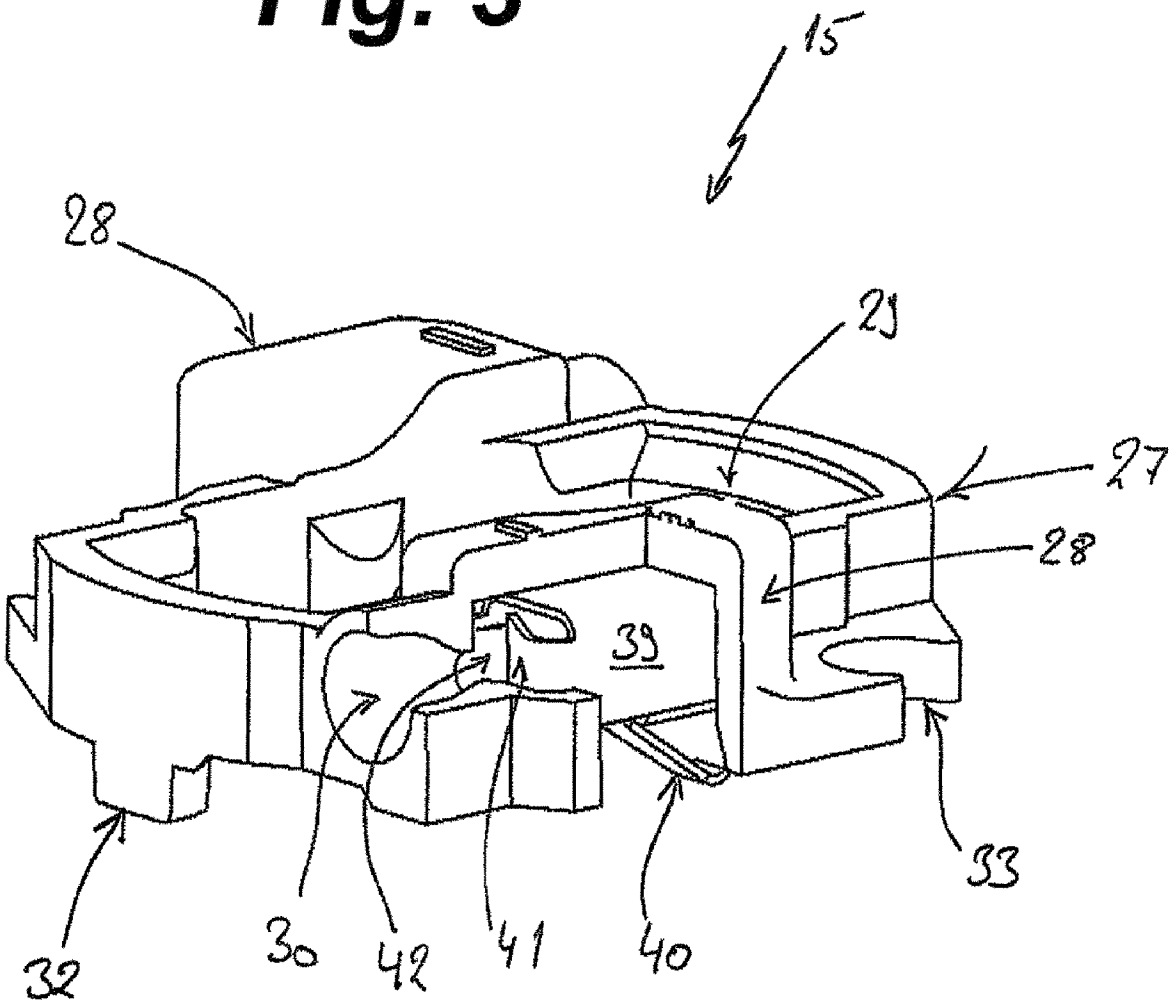
FIG. 3 is a perspective view of the connector according to the invention.

FIG. 3 shows the connector 15 with the housing 28 facing toward the observer partly broken away to show a contact element 39 inside it. This contact element 39 has a pressure contact in the form of a spring leg 40 extending axially downward toward the star circuit board and serving for engagement with its contact traces or solder pads 25. A gripping arm 41 of the contact element 39 is located at the hookup cable insert opening 30 across from a spring barbs 42. The arm 41 is biased against the barb 42 in an elastically resetting manner and is pushed from a rest position away from it on insertion of the stripped end 31 of a hookup cable 16. It and the barb 42 hold the hookup cable 16 firmly against removal against the insertion direction in an electrically contacting manner.

The LED light fixture shown in FIGS. 2 and 4 is assembled as follows:

The star circuit board 12 is positioned on the base 11 such that generally circularly arcuate cutouts 22 are aligned over the threaded bores 20 of the base 11. The connector 15 is placed on the star circuit board 12 with its positioning tabs 32 engage in the cutouts 22 of the star circuit board 12. This ensures the correct fit of the spring leg 40 on the contact pads or solder pads 25 for all commercially available star circuit boards 12 and ensures a correct positioning of the connector cutouts 33. The shanks 19 of the screws 14 are inserted into the bores 20 of the base 11 through the aligned cutouts 33 and 22. When the screws 14 are tightened, the screw heads 43 lock the connector 15 and the star circuit board 12 on the base 11. After the assembly of connector 15 and star circuit board 12, the lens holder 17 is snapped onto the connector 15 and finally the lens 18 is fitted in place on the holder 17.

FIG. 4 shows the assembled LED light fixture 10 again in partially sectional side view. One can see here how the contact 39 forms a pressure contact with its leg 40 and a clamping contact with its arm 41 and barb 42 for electrical connection of the LED 13. The locking between connector 15 and lens holder 17 by means of the latch barbs 29 and mating latches 34 is also clearly visible. Finally, how the screw shanks 19 engage through the cutouts 22 and 33 of the star circuit board 12 and connector 15 is shown. Likewise, the snapping of the optical element 18 into the lens holder 17 is very clearly visible.

FIGS. 5A through 7B respectively show in plan view a star circuit board 12 with an LED 13 held in an LED socket 23, the LED bases 23 having different outer peripheral shapes. Connectors 15 respectively associated therewith are shown in plan view, which are characterized by different shapes of the ring interior space 26 accommodating the LED 13. As can be seen at first glance, the interior space 26 of the ring interior in FIGS. 5A and 5B corresponds to the outer shape of the socket 23.

Figure 6B:
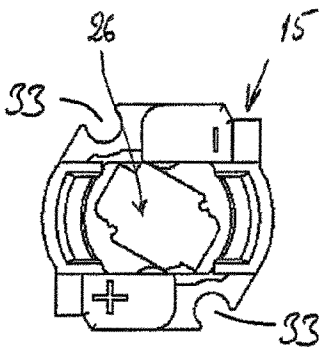
FIGS. 6A and 6B show a second star board and connector according to the invention.
Figure 6A:
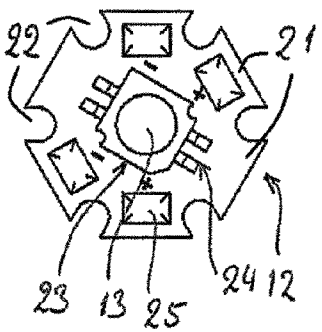
Figure 5B:
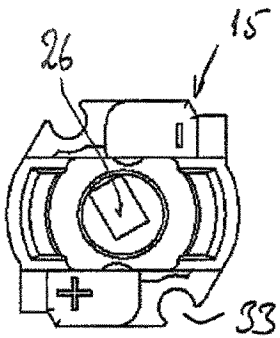
FIGS. 5A and 5B show a star board and connector according to the invention.
Figure 5A:
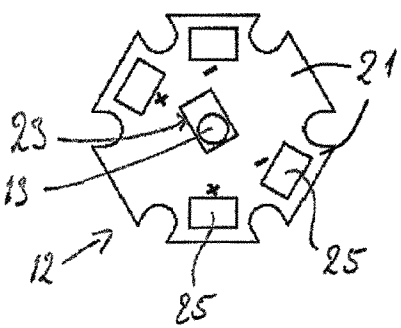

However, in FIGS. 6A and 6B the interior shape of the ring interior corresponds only partially to the base outer shape. In addition to a corresponding shape congruency, cutouts are formed for the contact feet 24 projecting from the socket 23. However, the shape of the ring interior space 26 corresponds sufficiently to the outer shape of the LED socket 23 that the connector 15 is optically centered on the axis A of the star circuit board 12 with respect to the LED 13. This produces overall a higher precision in interaction with all of the components compared to the alignment described above of the connector 15 and the star circuit board 12 for the purpose of solely securing the electrical contact.

Figure 7B:
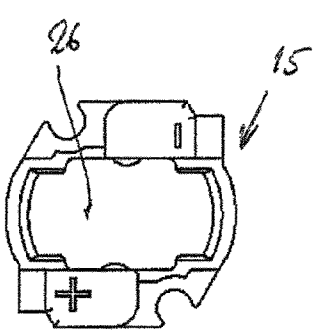
FIGS. 7A and 7B show a third, universal star board and connector in accordance with the invention.
Figure 7A:
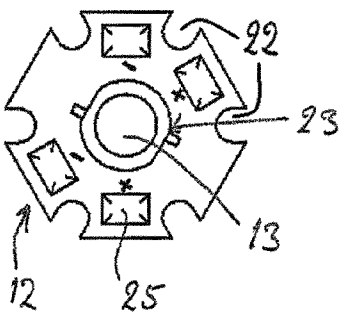

However, a connector 15 is shown in FIGS. 7A and 7B whose ring interior space 26 is cut completely out and does not show any shape congruence to one of the bases 23 shown. A connector of this type would be suitable for any of the star circuit boards 12 shown in FIG. 5A, 6A, or 7A.

Indicia showing the polarity +/− is provided on the contact pads 25 of the star circuit board 12 and on the housings 28 of the connector 15, so that it can be taken into account in the electric wiring of the LED 13. The correct assignment must be ensured during assembly, as semiconductor devices can be damaged when connected backward. However, it is also conceivable to produce only one possible assembly position by coding the shapes of the star circuit board 12 and the connector 15, such as additional axially off-center bore in the star circuit board 12 and a corresponding bump on the housing of the connector 15.

In conclusion, an extremely simple connector 15 for LEDs 13 is shown, by means of which a solderless electrical connection of the LED 13 mounted on a star circuit board 12 and at the same time the fixing of the star circuit board 12 on a base element, such as a cooling body, is possible.

We claim:

1. In combination:

a printed circuit board having an upper face provided with contact traces and pads;

a light-emitting diode fixed to the board and connected to the traces;

an annular connector juxtaposed with the pads and having an end face bearing on the upper face of the circuit board, the connector further being formed with a generally closed housing, axially closed by the upper face of the circuit board and having a hole on a peripheral wall of housing;

a hookup wire outside the connector and having a conductor extending through the hole into the housing;

a contact element in the housing and having a leg bearing with spring force on one of the pads and formations gripping the conductor of the wire;

a base; and at least one fastener engaged through the connector and circuit board with the base and pressing the connector against the circuit board and the circuit board against the base.

2. The combination defined in claim 1 wherein the connector is formed with two such generally closed housings open toward the board and each holding a respective such contact element with a respective such leg bearing on a respective pad of the board and respective such formations gripping a respective such wire.

3. The combination defined in claim 1 wherein the board is generally star shaped and centered on an axis and has a plurality of radially extending arms.

4. The combination defined in claim 1, further comprising a holder mounted on the connector over the light-emitting diode; and a lens in the holder.

5. The combination defined in claim 4 wherein the holder is separate from the connector.

6. The combination defined in claim 5 wherein the holder and the connector have interengaging and releasable latching formations.

7. The combination defined in claim 1 wherein the fasteners are screws threaded into the base and having heads bearing toward the base on the connector.

8. The combination defined in claim 1 wherein the contact element is unitarily formed of elastically deformable metal with the leg and formations.

9. The combination defined in claim 1 wherein the formations of the contact element include an arm and a barb between which a conductor of the wire is engageable.

10. The combination defined in claim 1 wherein the connector is made of dielectric plastic.

11. The combination defined in claim 1 wherein the base is made of metal.

12. The combination defined in claim 1 wherein the hole opens outwardly transversely of the axis.

13. The combination defined in claim 12 wherein the hole opens outwardly tangentially of the axis.

14. In combination:

a generally star-shaped printed circuit board having an upper face provided with contact traces and pads, centered on an axis, and having a plurality of radially extending arms;

a light-emitting diode fixed to the board and connected to the traces;

a hookup wire;

a connector juxtaposed with the pads and formed with cutouts through which the fasteners pass;

a contact element on the connector having a leg bearing with spring force on one of the pads and formations gripping the wire;

a base; and at least one fastener engaged through the connector and circuit board with the base and pressing the connector against the circuit board and the circuit board against the base.

15. The combination defined in claim 14 wherein the arms are separated by cutouts and the cutouts of the board align with the cutouts of the connector with the fasteners passing between the arms of the board.

16. In combination:

a printed circuit board having an upper face provided with contact traces and pads;

a light-emitting diode fixed to the board and connected to the traces;

a hookup wire;

a connector juxtaposed with the pads;

a contact element on the connector having a leg bearing with spring force on one of the pads and formations gripping the wire;

a base;

at least one fastener engaged through the connector and circuit board with the base and pressing the connector against the circuit board and the circuit board against the base; and a socket between the light-emitting diode and the board, the connector being generally annular and having a central space of a shape generally conforming to an outside shape of the socket.

17. In combination:

a printed circuit board having an upper face provided with contact traces and pads;

a light-emitting diode fixed to the board and connected to the traces;

a hookup wire;

a connector juxtaposed with the pads;

a contact element on the connector having a leg bearing with spring force on one of the pads and an arm and a barb between which a conductor of the wire is engageable for gripping the wire;

a base; and at least one fastener engaged through the connector and circuit board with the base and pressing the connector against the circuit board and the circuit board against the base, the arm and the barb being inclined such relative to each other that they permit the wire to be inserted between them in one direction but inhibit retraction from between them in the opposite direction.

* * * * *